US007651064B1

(12) United States Patent
Jackson

(10) Patent No.: US 7,651,064 B1
(45) Date of Patent: Jan. 26, 2010

(54) ROOF CLAMP

(75) Inventor: Trevor Jackson, Cleveland, OH (US)

(73) Assignee: Dyno Seasonal Solutions, LLC, Pompano Beach, FL (US)

( * ) Notice: Subject to any disclaimer, the term of this patent is extended or adjusted under 35 U.S.C. 154(b) by 70 days.

(21) Appl. No.: 11/861,609

(22) Filed: Sep. 26, 2007

Related U.S. Application Data

(60) Provisional application No. 60/828,321, filed on Oct. 5, 2006.

(51) Int. Cl.
*A47G 29/02* (2006.01)

(52) U.S. Cl. ..... 248/237; 248/229.14; 52/506.06; 362/249.07

(58) Field of Classification Search ..... 248/237, 248/314, 229.14; 362/249, 396, 145, 249.01, 362/249.1, 249.07, 249.08, 249.11; 52/24, 52/26, 57, 512, 506.06; 24/457, 459, 464, 24/487

See application file for complete search history.

(56) References Cited

U.S. PATENT DOCUMENTS 4,432,341 A * 2/1984 Howe et al. ..... 126/623
5,249,108 A * 9/1993 Gary ..... 362/388
5,316,108 A * 5/1994 Pearson ..... 187/408
5,581,956 A 12/1996 Fennessy et al.
5,772,166 A * 6/1998 Adams ..... 248/231.81
D414,291 S 9/1999 Gary et al.
D422,203 S 4/2000 Gary et al.
D424,418 S 5/2000 Gary et al.
D427,510 S 7/2000 Gary et al.
6,536,727 B1 3/2003 Limber et al.

* cited by examiner

*Primary Examiner*—Korie Chan
(74) *Attorney, Agent, or Firm*—Holland & Knight LLP

(57) ABSTRACT

The present invention relates generally to a roof clamp and, more specifically, to a plastic clamp that removable secures itself between shingles to attach a holiday decoration to the roof. The present roof clamp comprises a textured, rectangular backplate that is pushed under adjacent shingles. Two prongs extend from a center portion of the backplate such that they travel between the two adjacent shingles. A rectangular front plate is hingedly attached to the back plate along their lower lengths. The two prongs travel through two corresponding apertures on the front plate to lockingly engage the roof clamp in place by means of a catch release. A narrow plastic hook extends from the lower side of the backplate. A gripping prong is hingedly attached to the hook at its terminal end. The gripping prong is capable of rotating such that it can be manipulated to reconcile with and grasp the rigid angle of the decorative element it is holding. The instant abstract is neither intended to define the invention disclosed in this specification nor intended to limit the scope of the invention in any way.

10 Claims, 2 Drawing Sheets

ROOF CLAMP

RELATED APPLICATIONS

The present invention is a continuation of U.S. Provisional Application No. 60/828,321 and it claims a priority to its Oct. 5, 2006 filing date. The present invention incorporates all of the subject matter of ('321) as if it is fully rewritten herein.

BACKGROUND OF THE INVENTION

1. Field of the Invention

The present invention relates generally to a roof clamp and, more specifically, to a plastic clamp that removable secures itself between shingles to attach a holiday decoration to the roof.

2. Description of the Related Art

A themed, rooftop decoration can enhance the festive beauty of a home during any holiday season. A project to set up rooftop decorations can be a moderately complex task. It is an even more daunting task for those persons afraid of heights. For these persons, any time spent on a roof stabilizing a decoration and weighing it down is too much. A means to quickly attach decorations to a roof is attractive to those persons seeking a simple, one-step method. The present invention provides such a means, wherein at least one roof clamp is secured between adjacent shingles to position and to removably mount a decoration in place.

Similar apparatuses are well known in the art to aid in a mounting of holiday decorations. A search of the prior art revealed no patents that teach the claims of the present invention; however, the following references are considered pertinent:

U.S. Pat. No. 5,581,956 to Fennessy et al. teaches a universal decoration mounting arrangement that comprises a pair of angled lateral portions flanking a central portion such that they are oppositely engaged to frictionally detain the mounting member, wherein teeth are comprised on the lateral portions to dig into the roof;

U.S. Pat. No. 6,536,727 to Limber et al. teaches a Christmas light clip that comprises a plastic U-shaped clip portion having both a pair of leg sections to provide a biasing force that acts on a roof shingle inserted between them, wherein a different concave light string attachment portion is located on each side of the clip portion; and, U.S. Des. Pat. Nos. 427,510, 424,418, 422,203 and 414, 291, all to Gary et al., show shingle and gutter clips to support decorative and icicle lights, wherein the designs all comprise a base portion having a concave leg that extends from its terminal end and the opposing distal end of the concave leg comprises a convex portion that acts to secure a gutter or a shingle therebetween.

While some of the features disclosed in the foregoing references are claimed in the present invention, others are distinct enough so as to distinguish the present roof clip over the prior art. The Limber and the Gary references all teach light string attachment sections in the form of at least one arcuately shaped, pronged gripping clip. The present invention also teaches a form of a gripping prong that extends from a hook, but it rather teaches an improved prong that is hingedly attached to the hook such that it can be manipulated to support a rigid decoration from various angles.

There is a long felt need for an improved roof clamp that makes a mounting of roof-top decorations a fast and a simple process. The present invention teaches a clamp that is simply inserted between the shingles.

SUMMARY OF THE INVENTION

It is an object of the present roof clamp to make an attachment of a decoration to a roof an easy, one-step method.

It is an object that the present roof clamp is designed specifically for a convenient use with rooftop shingles.

It is an object of the present invention to not require the use of any tools to mount the roof clamp to shingles.

It is an object of the present invention to provide a roof clamp that removable secures to a roof, but one that is also durable enough to remain permanently secured to a roof for those persons who attach lights and decor to it on all holidays.

It is an object of the present roof clip to tightly secure any lighted decorations close to a roof such that the wind cannot forcibly bang and damage bulbs against the roof.

It is envisioned that the present roof clamp will accomplish these objectives by means of a textured, rectangular backplate that is pushed under adjacent shingles. Two prongs extend from a center portion of the backplate such that they travel between the two adjacent shingles. A rectangular front plate is hingedly attached to the backplate along their lower lengths. The two prongs travel through two corresponding apertures on the frontplate to lockingly engage the roof clamp in place. A squeeze of the two prongs towards one another releases the front plate from the back plate.

A narrow plastic hook extends from the lower side of the backplate. A gripping prong is hingedly attached to the hook at its terminal end. The gripping prong is capable of rotating such that it can be manipulated to reconcile with and grasp the rigid angle of the decorative element it is holding.

A plurality of the present roof clamps can be strategically placed on spaced shingles so that the holiday decoration it is holding can be securely mounted to the roof on all of its sides.

It is a final object of the present invention to provide all of the advantages that the foregoing objects entail.

BRIEF DESCRIPTION OF THE DRAWINGS

The advantages and the features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
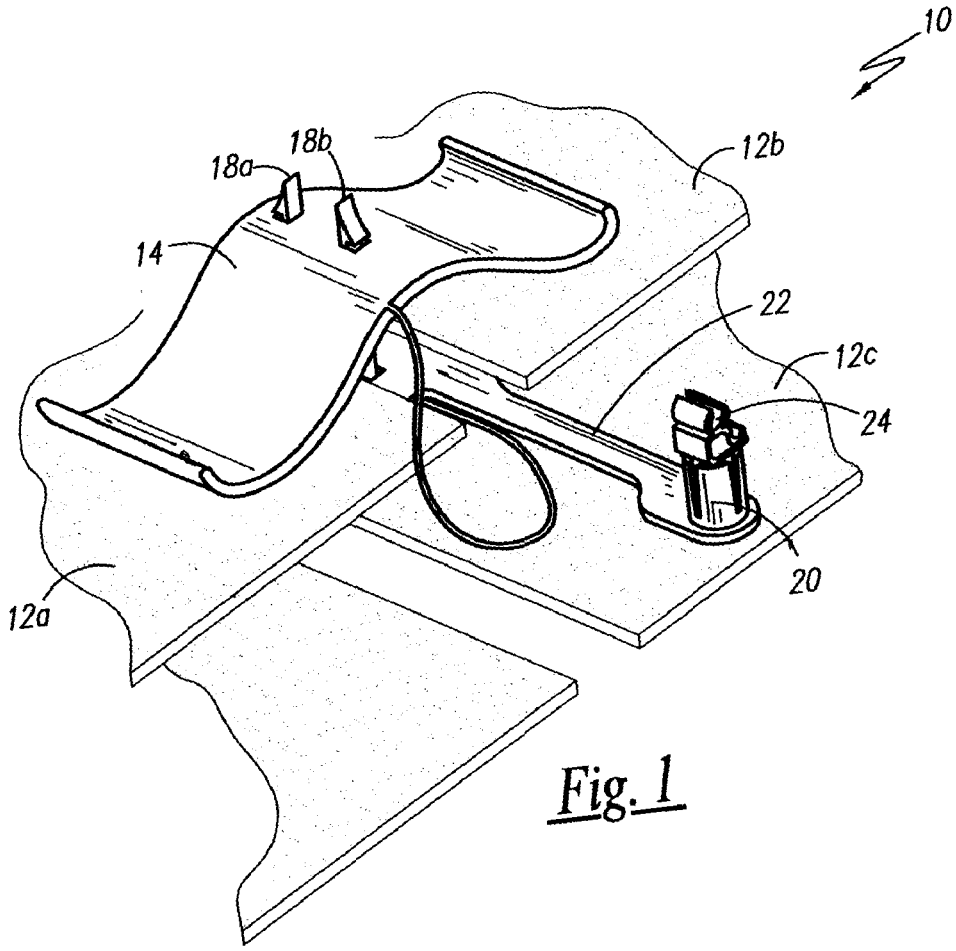
FIG. 1 is a front elevational view of a roof clamp according to a preferred embodiment of the present invention.
Figure 2:
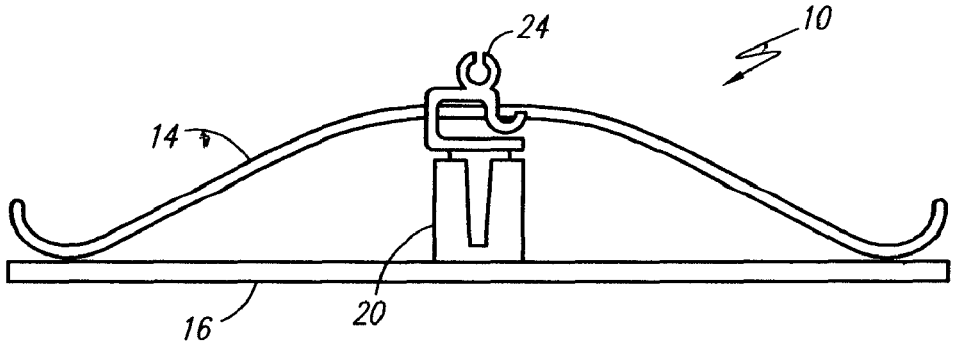
FIG. 2 is a front view of the roof clamp shown in 1.

A roof clamp 10 is shown in FIGS. 1 and 2 according to a preferred embodiment of the present invention. The roof clamp 10 is shown mounted to common asphalt shingles that are slightly overlapped at their long perimeters. A textured, rectangular backplate (not shown) is pushed under a pair of adjacent shingles 12*a*, 12*b* such that it is sandwiched between both the pair of adjacent shingles and the bottom shingle 12*c* that the pair overlap. Standard shingles are commonly covered with granules to give them a textured appearance. A similar textured portion of the backplate provides an extra frictional hold between the backplate and the shingles 12*a-c* such that the backplate is not at risk for sliding from its sandwiched position.

A rectangular front plate 14 is hingedly attached to the backplate at their lower lengths 16. A means to attach (not shown) the front plate 14 to the backplate is any of those means well known in the art; however, the roof clamp 10 is not limited to any one form of attachment solely at or along the length. Similarly, the front plate 14 of the roof clamp 10 is not limited to the rectangular shape shown in the figures, but it may rather comprise any shape that provides it with an ability to accomplish the present functions.

Two prongs 18*a*, 18*b* extend from a center portion of the backplate. When the front plate 14 is not hingedly attached to the backplate, these prongs travel between the two adjacent shingles 12*a*, 12*b* such that the back plate is centered directly between the two. When the front plate 14 is hingedly closed upon the backplate, the two prongs 18*a*, 18*b* travel through two corresponding apertures (not shown) on the front plate to lockingly engage the roof clamp 10 in place. The bases of the two prongs 18*a*, 18*b* essentially engage the top side of the front plate 14 by means of a catch release. A squeeze of the two prongs 18*a*, 18*b* towards one another releases the catch lock to open the front plate 14 from the backplate.

A narrow plastic hook 20 extends from a lower portion of the backplate. A straight leg 22, or a straight shank, of the hook 20 travels parallel to and adjacent to the bottom shingle 12*c*. A gripping prong 24 is rotatably attached to a bend in the hook 20 at, and perpendicular to, a terminal end of the leg 22. The gripping prong 24 is capable of rotating such that it can be manipulated to reconcile with and grasp the rigid angle of the decoration 26 it is holding. The gripping prong 24 comprises two arcuate hands 28*a*, 28*b* that grab a portion of the decoration 24. The decoration 26 is namely secured therebetween by means of an interference fit.

It is preferred that the present roof clamp 10 is manufactured from a weather-resistant, durable plastic material so that it can withstand outdoor elements. It is further envisioned that the roof clamp 10 is manufactured in a plurality of colors and, most preferably, in the colors that blend with and match the shingles so that the roof clamp is not readily noticeable in daylight, s.a., in browns, charcoals, greys, black and greens.

Figure 3:
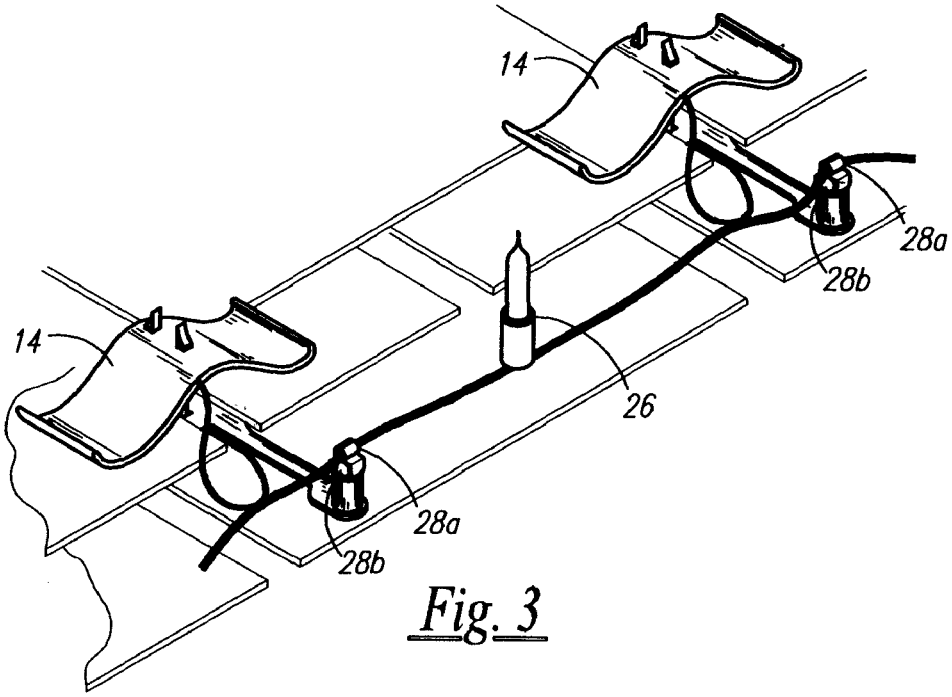
FIG. 3 shows a plurality of roof clamps mounted to a roof to support a holiday decoration.

A plurality of the present roof clamps 10 can be strategically placed on spaced shingles so that the holiday decoration it is holding can be securely mounted to the roof on all of its sides. FIG. 3 shows four roof clamps 10*a*, 10*b*, 10*c*, 10*d* holding a bell shaped holiday decoration 26. As can be seen in the figure, the bell comprises a curved, rigid frame. The prongs on each roof clamp 10*a-d* rotate to angle themselves to match the curve, whereupon the each of them frictionally grasp the bell. In this manner, many different kinds of holiday decorations can be removably mounted to a rooftop, including holiday lights, patriotic wreaths, etc.

2. Operation of the Preferred Embodiment

To operate the present invention, the rectangular backplate of the roof clamp is pushed under a pair of adjacent shingles such that it is sandwiched between both the pair of adjacent shingles and the bottom shingle that the pair overlap. The front plate is hingedly closed upon the top plate to sandwich the adjacent shingles between it and the bottom plate. The pair of prongs that extend from the backplate catch the front plate to lockingly engage the two. The prong attached at the bend in the hook is rotated to approximate the angle of the portion of the decoration it is to secure. The decoration is pushed between the hands on the rotatable prong to secure it therebetween.

To unmount the decoration, the portion of the decoration secured between the hands of the prong is lightly tugged to release it from the hands. The prongs that lockingly engage the front plate to the back plate are pushed toward one another to release the lock so that the front plate can be hingedly opened away from the backplate. The backplate is forcefully pulled from its sandwiched position between the shingles, whereupon it can be stored until further use. Alternatively, the roof clamp can remain on the rooftop during a number of seasons while a number of different, thematic decorations are removably mounted to the hook portion.

The foregoing descriptions of specific embodiments of the present invention have been presented for the purposes of illustration and description. They are not intended to be exhaustive nor to limit the invention to the precise forms disclosed and, obviously, many modifications and variations are possible in light of the above teaching. The embodiments were chosen and described in order to best explain the principles of the invention and its practical application, to thereby enable others skilled in the art to best utilize the invention and the various embodiments with various modifications as are suited to the particular use contemplated. It is intended that the scope of the invention be defined by the Claims appended hereto and their equivalents. Therefore, the scope of the invention is to be limited only by the following claims.

Having thus described the invention what is claimed as new and desired to be secured by Letters Patent is as follows:

1. A roof clamp to mount holiday decorations to rooftop shingles, said roof clamp comprises:

a backplate pushed under a pair of adjacent shingles such that it is sandwiched between both said pair of adjacent shingles and a bottom shingle that said pair overlap;

a front plate hingedly attached to said backplate at their lower lengths;

two prongs that extend from a center portion of said backplate;

two apertures that travel through a center of said front plate, said two apertures correspond to said two prongs;

a narrow hook that extends from a lower portion of said backplate; and, a gripping prong rotatably attached to a bend in said hook.

2. The roof clamp of claim 1, wherein said backplate is textured to provide said backplate with an extra frictional hold between said shingles.

3. The roof clamp of claim 1, wherein when said front plate is not hingedly attached to said backplate, said prongs travel between said pair of adjacent shingles such that said backplate is centered directly between the two.

4. The roof clamp of claim 1, wherein when said front plate is hingedly closed upon said backplate, said two prongs travel through said corresponding apertures on said front plate to lockingly engage said roof clamp in place, the bases of said two prongs essentially engage a top side of said front plate by means of a catch lock release.

5. The roof clamp of claim 4, wherein a squeeze of said two prongs towards one another releases said catch lock to open said front plate from said backplate.

6. The roof clamp of claim 1, wherein said hook comprises a straight leg that travels parallel to and adjacent to said bottom shingle.

7. The roof clamp of claim 1, wherein said gripping prong is capable of rotating such that it can be manipulated to reconcile with and grasp a rigid angle of said decoration it is holding.

8. The roof clamp of claim 1, wherein said gripping prong comprises two arcuate hands that grab a portion of said decoration, said decoration is namely secured therebetween by means of an interference fit.

9. The roof clamp of claim 1, wherein said roof clamp is manufactured from a weather-resistant, durable plastic material.

10. The roof clamp of claim 9, wherein said roof clamp is manufactured in a plurality of colors that blend with and match said shingles so that said roof clamp is not readily noticeable in daylight, said colors are selected from a group that comprises browns, charcoals, greys, greens and black.

* * * * *